US006551475B2

(12) United States Patent
Dwyer et al.

(10) Patent No.: US 6,551,475 B2
(45) Date of Patent: Apr. 22, 2003

(54) CORNER INSERT FOR EDGE STRIPS USED WITH MODIFIED ELECTRODES FOR ELECTROLYTIC PROCESSES

(75) Inventors: Michael P. Dwyer, Tucson, AZ (US); Manuel G. Santoyo, Tucson, AZ (US); David Watson, Tucson, AZ (US); Stephen R. Lopez, Tucson, AZ (US)

(73) Assignee: Quadna, Inc., Tucson, AZ (US)

( * ) Notice: Subject to any disclaimer, the term of this patent is extended or adjusted under 35 U.S.C. 154(b) by 0 days.

(21) Appl. No.: 09/978,798

(22) Filed: Oct. 15, 2001

(65) Prior Publication Data

US 2002/0017457 A1 Feb. 14, 2002

Related U.S. Application Data

(63) Continuation-in-part of application No. 09/579,653, filed on May 26, 2000, now Pat. No. 6,312,573.

(51) Int. Cl.[7] ..... C25D 1/00
(52) U.S. Cl. ..... 204/281; 204/279
(58) Field of Search ..... 204/279, 281

(56) References Cited

U.S. PATENT DOCUMENTS 5,690,798 A * 11/1997 Alexander et al. ..... 204/281
6,017,429 A * 1/2000 Persson ..... 204/281
6,193,862 B1 * 2/2001 Cutmore et al. ..... 204/281
6,312,573 B1 * 11/2001 Dwyer et al. ..... 204/281

* cited by examiner

*Primary Examiner*—Bruce F. Bell
(74) *Attorney, Agent, or Firm*—Garth E. Janke; Birdwell Janke & Durando, LLP

(57) ABSTRACT

A corner insert for edge strips used with modified electrodes for electrolytic processes. An electrode that is at least partially submerged in an electrolyte is protected by edge strips to prevent depositions and metallic bridges. The edge strips are typically mitered to abut one another at the corners of the electrode and it is difficult to seal this junction. One solution is to remove the corners of the electrode, provide non-mitered edge strips, and close the gap at the corner with an insert adapted to seal to the additional edges of the electrode created by removing the comers. Another solution is to provide a corner insert having one or more anchors for anchoring the corner insert to the electrode and to respective adjacent edge strips, the corner insert sealing against the edge strips and against opposite sides of the electrode whether or not the corner portion has been removed. Yet another solution is to omit an edge strip at the bottom edge of the electrode, and provide an edge strip insert having an anchor for anchoring the edge strip insert to the electrode and to an edge strip which receives the anchor, the edge strip insert for sealingly seating against the edge strip and against opposite sides of the electrode whether or not the corner portion has been removed.

19 Claims, 9 Drawing Sheets

CORNER INSERT FOR EDGE STRIPS USED WITH MODIFIED ELECTRODES FOR ELECTROLYTIC PROCESSES

This application is a continuation-in-part of Ser. No. 09/579,653, filed May 26, 2000, now U.S. Pat. No. 6,312,573.

BACKGROUND OF THE INVENTION

1. Field of the Invention

The invention relates generally to electrolytic processes and apparatus for refining metals and, in particular, to an improved edge strip assembly for mother plates that have been modified by the removal of corner portions.

2. Description of the Prior Art

Electrolysis is utilized to extract metals and other cations from an electrolytic solution. The extraction process involves passing an electric current through an electrolyte solution of a metal of interest, such as copper, gold, silver, or lead. The metal is extracted by electrical deposition as a result of current flow between alternating anode and cathode plates immersed in cells of an extraction tank house. In electrowinning processes, a solution of metal-rich electrolyte is circulated through the extraction cells. The cathode is generally constructed of a metal alloy, such as titanium or copper alloys, and various grades of stainless steel which are resistant to corrosive acid solutions. Typically, each cathode consists of a thin sheet of metal of uniform thickness, e.g., 2–4 mm, disposed vertically between parallel sheets of anodic material, so that a uniform current density is maintained throughout the surface of the cathode. A pure layer of metal is electrodeposited on the cathode surface, which thus becomes plated during the process, upon passing of an electric current through the electrolyte.

Similarly, in refinery metal-purification processes, an anode of impure metal is placed in an electrolytic solution of the same metal and subjected to an electric current passing through the anode, the electrolyte and the cathode of each cell, The anode goes into solution, thereby separating the metal from impurities, which drop to the bottom of the tank. The electrical current then produces the deposition of the dissolved metal in pure form on the cathode, which typically consists of a mother plate of stainless steel. When a certain amount of pure metal has been plated onto the mother plate, the cathode is pulled out of the tank and stripped of the pure metal.

In both processes, the pure metal deposit is grown to a specific thickness in sheets deposited on each side of the cathode, and then the cathode is removed from the cell and stripped. For quality control purposes, it is very desirable that these sheet deposits be uniform in shape and thickness, so that they can be easily removed by automated stripping equipment. The overall economy of the production process, depends in part on the ability to mechanically strip the cathodes of the metal sheets at high throughputs and speeds without utilizing manual or physical intervention. To that end, the mother plates have a surface finish that is resistant to the corrosive solution of the tank house and is strong enough to withstand continuous handling by automated machines without pitting or marking. Any degradation of the finish of the blank causes the electrodeposited metal to bond with the cathode resulting in difficulty of removal and/or contamination of the deposited metal.

If deposition is allowed to occur at the edges of a cathode, metallic bridges form between the deposited sheets on either side of the cathode. These metallic bridges, which can wrap around the edges of the cathode, hinder the stripping operation and can cause damage to the sheets and/or the cathode. To alleviate this problem, nonconductive strips known as edge strips or protector strips are placed over the submerged bottom and side edges of the cathode. The edge strips are normally mechanically fixed to the cathode with glued pins or pin inserts. In addition to inhibiting the formation of metallic bridges, edge strips function to prevent direct contact between the cathode and the adjacent anodes.

As is well understood in the art, at each lower corner of a cathode the vertical edge strips, mounted on the side edges of the mother plate, define junctions with the horizontal edge strip mounted on the bottom edge. Often glue is applied to these junctions to prevent penetration of the electrolyte into, and an accompanying deposition of metal around, the junctions. However, over time, the glue develops cracks which permit leakage of the electrolyte into the junctions. Eventually, the edge strips must be removed to allow removal of deposits accumulated on the edge of the cathode in the junction areas. The process of removing the edge strips, cleaning the cathode and replacing the edge strips is time-consuming and also keeps the cathode out of service; therefore, it is very undesirable.

In order to further reduce the likelihood of electrolyte penetration into corner junctions, manufacturers have improved the fit between abutting parts of adjoining strips. This objective has required greater precision finishing of the edge strips and more accurate positioning of the strips on the cathode during installation, so that manufacturing as well as mounting costs have increased. To obtain a better fit, edge strips are sometimes also mitered, which further increases manufacturing and installation time.

U.S. Pat. No. 5,690,798 describes a corner protector designed to wrap around the side and bottom edge strips abutting at the lower corners of a mother plate. The protector has a vertical channel adapted to receive the lower end of a vertical edge strip, a horizontal channel adapted to receive an end of the bottom edge strip, and a cutout for the corner of the mother plate. Thus, the protector provides additional separation between the edges of the cathode and the electrolytic solution, but it involves the use of an additional component with attendant supply, installation and maintenance costs.

A notable improvement recently found in the art, based on a different approach to reducing electrodeposition at the lower corners of cathodes, has been to cut away the corner portions of the mother plate covered by abutting side and bottom edge strips. Thus, the accumulation of electrolyte deposits is avoided by eliminating the metallic substrate upon which deposition may occur. Unfortunately, though, electrolyte seepage still causes deposition along the edges of the cut-away corners covered by the edge strips. The use of caulking and/or binding material, such as silicone, to seal the abutting parts of adjoining edge strips delays but does not prevent the eventual penetration of electrolyte and accumulation of deposits.

Therefore, there is still a need for an improved system of cathode-edge protection designed to overcome these problems, especially the accumulation in the comer areas of the mother plate. The present invention provides a new edge-strip component that fulfills this need for mother plates that have been modified by the corner cut-away approach described above.

Another aspect of the present invention provides a new edge-strip component that fulfills this need for mother plates whether or not modified by the corner cut-away approach described above.

In one embodiment of the invention corresponding to this aspect, a corner insert is provided having one or more anchors for anchoring the corner insert to the electrode and to respective adjacent edge strips, the corner insert sealing against the edge strips and against opposite sides of the electrode whether or not the corner portion has been removed.

In another embodiment of the invention corresponding to this aspect, the edge strip at the bottom of the electrode is omitted and an edge strip insert is provided having an anchor for anchoring the edge strip insert-to the electrode and to an edge strip which receives the anchor, the edge strip insert sealing against the edge strip and against opposite sides of the electrode whether or not the corner portion has been removed.

SUMMARY OF THE INVENTION

The main object of the invention is an edge strip system that reduces the accumulation of electrolyte at the lower corners of cathode mother plates.

In particular, an object of the invention is a system intended for application with mother plates where the lower corners have been removed.

An additional object of the invention is to provide an accessory component suitable for use with existing side and bottom edge strips.

One more object of the invention is to provide a method of protecting the lower corners of an electrode assembly so as to enable operation for longer periods of time without cleaning.

A further object of the invention is to provide a system that can be implemented economically according to the above stated criteria.

According to the preceding objects, as well as others that will become apparent as the description proceeds, the invention consists of a nonconductive insert adapted to fill the void resulting from the absence of mother-plate corners wrapped within the abutting ends of side and bottom edge strips. In the preferred embodiment of the invention, the insert comprises a plate of dimensions commensurate with the metal corner removed from the mother plate, so that the resulting void is filled. The insert includes at least one anchor, preferably two, adapted to frictionally engage the end of a strip mounted along the edge of the mother plate. If two anchors are used, they are disposed at a right angle to make it possible to attach the insert to both edge-strip ends coming together at a corner of the mother plate. The insert and its anchors are designed to completely fill the void left by the missing mother-plate corner, thereby preventing penetration of electrolyte and accumulation of deposits. Additional protection and stability of assembly may be provided by bonding the insert to both adjoining edge-strip ends with glue.

According to other embodiments of the invention, the insert may be incorporated into the edge-strip end as an integral component of the strip. In such case, the end of the integrated insert may include a lateral anchor adapted for frictional engagement of the end of a conventional edge strip to form a corner junction. This design is particularly suitable for injection molded manufacture. When a single, vertical edge strip is used (bottom edge strips are sometimes not utilized), the lateral anchor is not necessary.

Thus, the insert of the invention, whether implemented as an accessory to or as an integral component of an edge strip, serves as a plug for the missing corner of a modified electrode and a filler for the resulting void left within adjacent corner ends of the side and bottom strips mounted on the edges of the mother plate. The insert prevents seepage of electrolyte to the corner site and to adjacent portions of the mother-plate edges encased in the edge strips, so that less frequent cleaning of the corner areas is required.

Another aspect of the invention resides in a method of making an electrolytic electrode assembly. The method comprises the steps of providing an electrode having a first edge, a second edge perpendicular to the first edge, and an insert corresponding to the removal of a corner portion at the intersection of the two edges; placing a first edge strip over the first edge so that an end thereof is in the region of the intersection; placing a second edge strip over the second edge so that an end thereof is in the region of the intersection, and replacing the missing corner portion of the electrode with an insert of nonconductive material confined by the ends of the first and second edge strips. The method can further comprise the step of adhesively connecting the insert to the ends of the edge strips.

Another aspect of the invention resides in a nonconductive insert that may be used for mother plates whether or not a corner of the mother plate has been removed. In one embodiment, the insert includes a corner member having an aperture that defines interior surfaces for seating against opposite sides of the mother plate, and is adapted to sealingly seat against an end of the edge strip. In another embodiment, the insert includes a corner member having an aperture that defines interior surfaces for seating against opposite sides and corner edges of the mother plate.

In yet another embodiment of the invention, a nonconductive insert may be used for plugging an edge strip having an end defining a cross-sectional circumference, the insert comprising a base from whose upper surface extend spaced-apart prongs, the prongs having interior surfaces adapted to seat, respectively, against the sides of the mother plate and the upper surface of the base adapted to seat against the end of the edge strip around substantially the entire length of the circumference. The base may include a slot therethrough, disposed between the interior surfaces of the prongs, so that the bottom edge of the mother plate may be flush with or extend beyond the bottom surface of the base. The base may also include a corner insert for filling the void in a mother plate which has had its corner removed.

Various other purposes and advantages of the invention will become clear from its description in the specification that follows and from the novel features particularly pointed out in the appended claims. Therefore, to the accomplishment of the objectives described above, this invention consists of the features hereinafter illustrated in the drawings, fully described in the detailed description of the preferred embodiment and particularly pointed out in the claims. However, such drawings and description disclose but one of the various ways in which the invention may be practiced.

DESCRIPTION OF THE PREFERRED EMBODIMENTS

The gist of the invention resides in the idea of providing a nonconductive insert to replace the portion of a mother-plate corner removed to avoid deposition of electrolyte at the corner junctions between side and bottom edge strips. For the purposes of this disclosure, the terms "modified electrode" and "modified mother plate" are intended to refer to conventional electrodes and mother plates where the bottom corners have been so removed.

Figure 1:
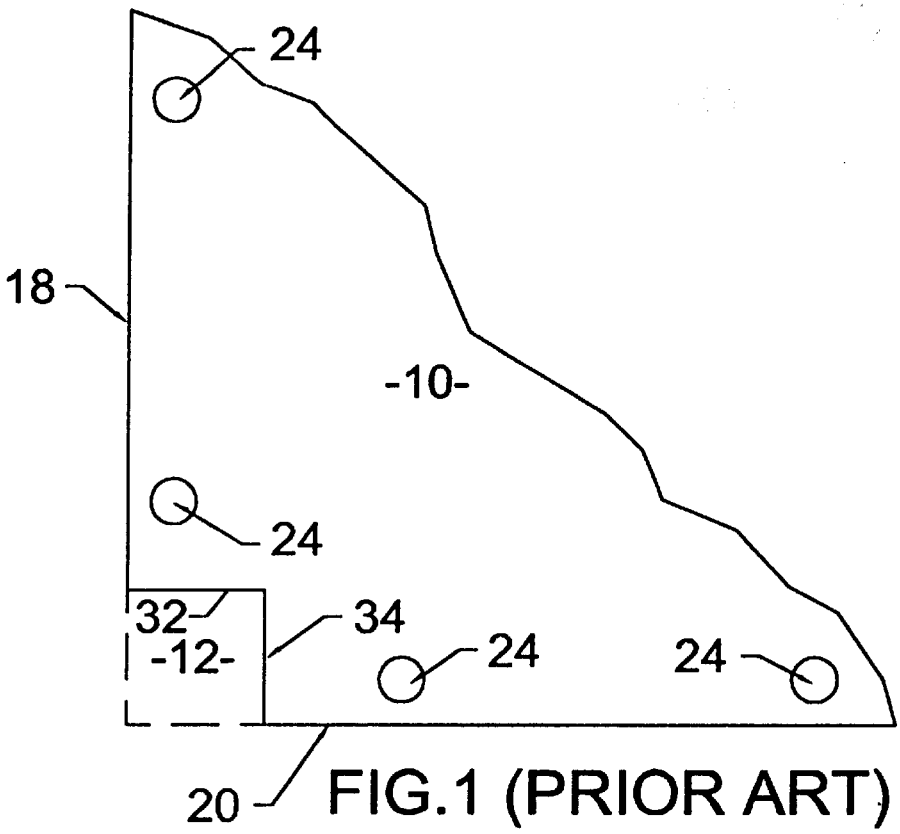
FIG.1 (PRIOR ART)
FIG. 1 is an elevational, fragmentary view of a mother plate found in prior art where a corner section has been cut out to prevent accumulation of deposits resulting from electrolyte seepage into a corner junction of edge strips.

Referring to the drawings, wherein like parts are referred to throughout with like numerals and symbols, FIG. 1 is a partial view of a modified mother plate 10 having a corner section 12 removed (shown in phantom line), as explained above. Conventional edge strips 14, as illustrated in cross-section in FIG. 2, include a longitudinal channel 16 adapted to receive an edge 18 (or 20) of the mother plate in tight connection to prevent seepage of electrolyte inside the strip. A wider longitudinal slot 22, running within the channel 16, is provided to receive retaining opposite ends of pins 24 inserted through and protruding on both sides from the border of the mother plate. Each edge strip is installed on the mother plate by sliding the slot 22 over the pins 24, so that the strip becomes engaged by the pins and firmly retained in place over the border of the electrode to protect its edge. The length of the pins 24 is preferably chosen to be approximately the same as the width of the slot 22 to ensure firm installation and durability of the resulting assembly.

Figure 3:
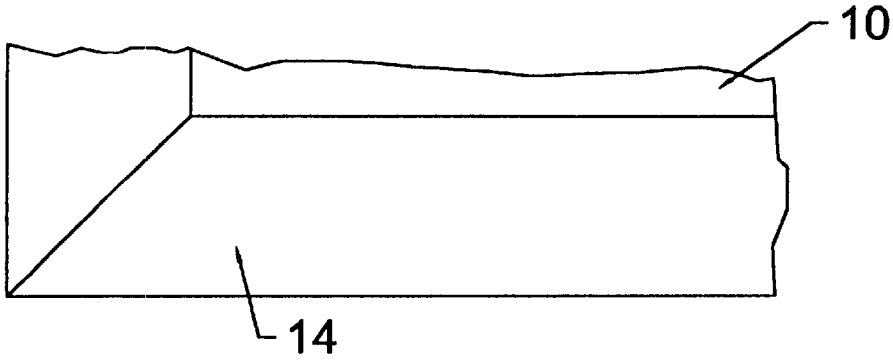
FIG.3 (PRIOR ART)
FIG. 3 is an elevational view of a corner junction between two mitered edge strips according to conventional practice.
Figure 4:
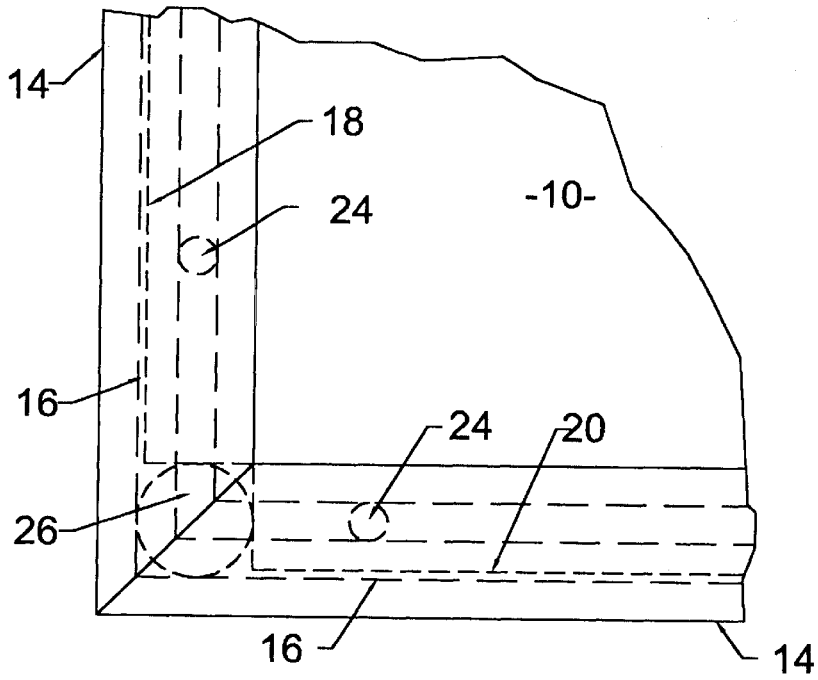
FIG.4 (PRIOR ART)
FIG. 4 illustrates the void defined by the channels and slots of conventional edge strips when joined to form a corner junction over a modified mother plate.

Conventional strips are also often mitered at a 45-degree angle for corner junctions, as illustrated in FIG. 3. Therefore, when these edge strips are installed on a modified electrode, the empty portions of channels 16 and slots 24 resulting from the missing section 12 of the modified electrode in adjoining ends of mitered edge strips create a void at the corner location, as approximately illustrated by the phantom-line circle 26 in FIG. 4. When electrolyte penetrates the seal formed by the mitered surfaces of the edge strips abutting at the corner, damaging deposits form in the cavity produced by the structure of the modified electrode.

Figure 5:
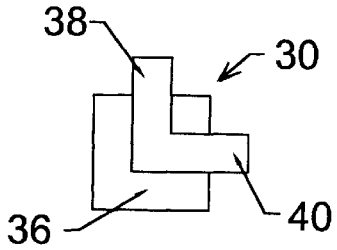
FIG. 5 is an elevational front view of an insert according to the invention.
Figure 6:
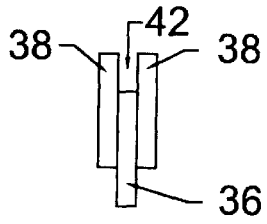
FIG. 6 is a side view of the insert of FIG. 5.
Figure 7:
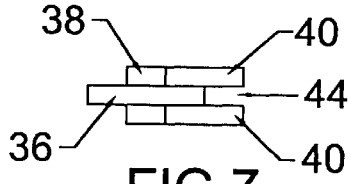
FIG. 7 is a top view of the insert of FIG. 5.

According to the present invention, a nonconductive insert 30, shown in FIGS. 5–7, is provided to fill the cavity defined by the channels 16, the slots 22, and the cut-out corner edges 32 and 34 of the modified mother plate 10. Accordingly, the insert 30 includes a plate 36 of dimensions substantially equal to the section 12 removed from the corner of the mother plate 10 for which the invention is intended, so that the insert 30 will fill the void created by its removal. In addition, the insert 30 includes orthogonal anchors 38 and 40 projecting in the directions of the slots 22 in the edge strips mounted on the side and bottom of the modified mother plate. As better seen in the side and top views of FIGS. 6 and 7, each anchor 38,40 is sized so that it can be press-fit around the edge of the mother plate 10 through the end of a corresponding slot 22. Specifically, referring to the side view of FIG. 6, the opening 42 within two prongs of the anchor 38 is adapted to receive the edge 32 of the mother plate; and the opening 44 within two prongs of the anchor 40 is adapted to receive the edge 34 of the plate in tight frictional connection. Each prong is sized to fit in the longitudinal openings left in the slot 22 on either side of the mother plate after the edge strip is mounted on the plate.

Figure 10:
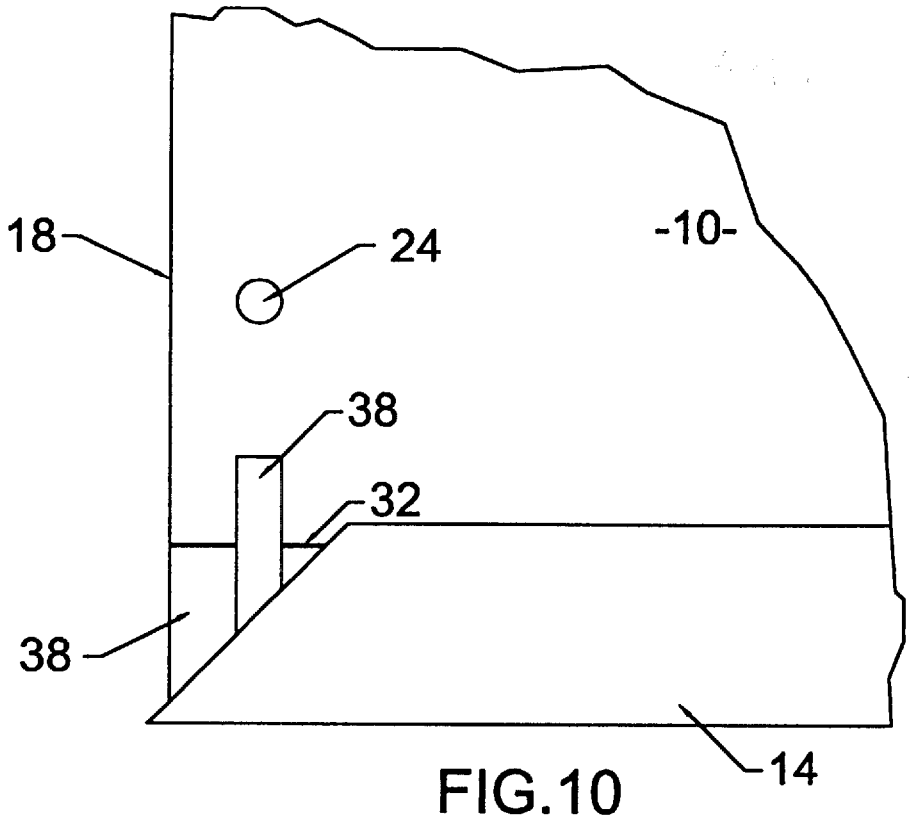
FIG. 10 illustrates the edge strip assembly of FIG. 8 installed on the bottom edge of a modified mother plate.
Figure 8:
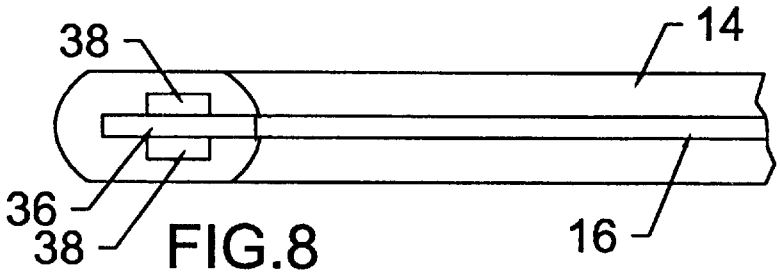
FIG. 8 is a top view of an edge strip including the insert of the invention, either as a separate component fitted into the end slot of the strip, or as an integral part thereof
Figure 9:
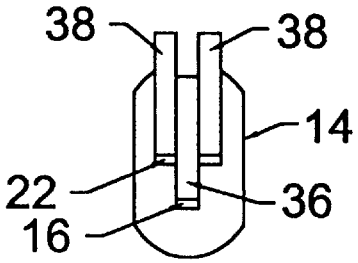
FIG. 9 is a side view of the edge strip assembly of FIG. 8.

FIGS. 8 and 9 illustrate in top and side views, respectively, the insert 30 of the invention as it would appear when inserted into a single edge strip 14. FIG. 10 shows the same partial assembly mounted on the bottom edge of a mother plate 10. As one can appreciate from these figures, it is clear that the further installation of a vertical edge strip by sliding it into position through the retaining pins 24 and the anchor 38 (in the slot 22) produces a compact corner assembly with essentially no residual empty space. In order to complete the elimination of interstices within the corner junction and further strengthen the assembly, a glue may be applied to all abutting surfaces during installation. Inasmuch as the insert 30 is made of nonconductive material, preferably the same as the main constituent of the edge strips, the edges 32 and 34 of the modified electrode are fully protected from electrical contact with the electrolyte solution and the corner sections are thereby durably prevented from accumulating metallic deposits.

Figure 2:
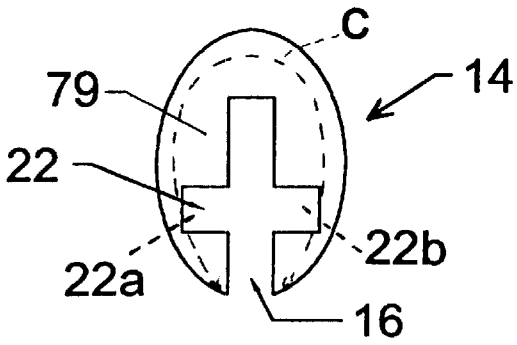
FIG.2 (PRIOR ART)
FIG. 2 is an end view of a conventional edge strip.

In the preferred embodiment of the invention, the insert 30 is sized to fit a conventional edge strip of the type illustrated in FIG. 2. Accordingly, the plate 36 is approximately 16 mm long, 16 mm wide, and 3 mm thick. The anchors 38,40 are about 20 mm long, 7 mm wide, and extend about 10 mm beyond the plate 36. Each prong in the anchors is defined by a 3-mm opening (42,44) for receiving the edge (32,34) of a mother plate 10.

The insert 30 of the invention has been described as a separate accessory component for use with conventional edge strips. On the other hand, the insert could be equivalently incorporated as an integral part of an edge strip of unitary construction. Such an embodiment would have exactly the same appearance of the assembly shown in FIGS. 8 and 9, but it would consist of a single-piece, preferably injection-molded, unit.

Figure 11:
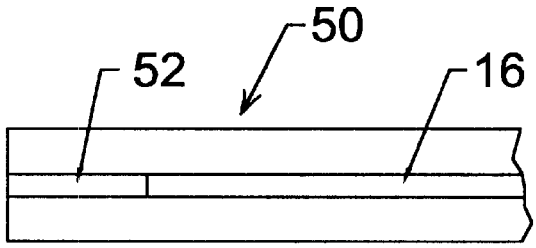
FIG. 11 illustrates an edge strip of unitary construction with a solid end plug designed for vertical-edge applications where a bottom edge strip is not used.
Figure 12:
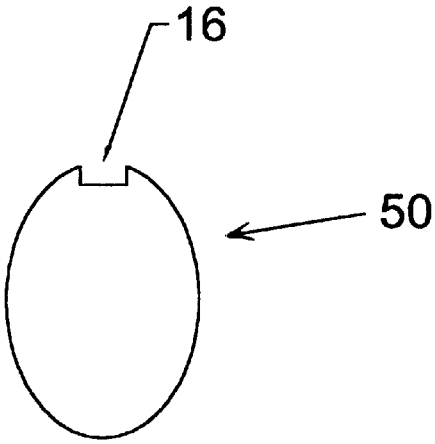
FIG. 12 is an end view of the edge strip of FIG. 11.
Figure 13:
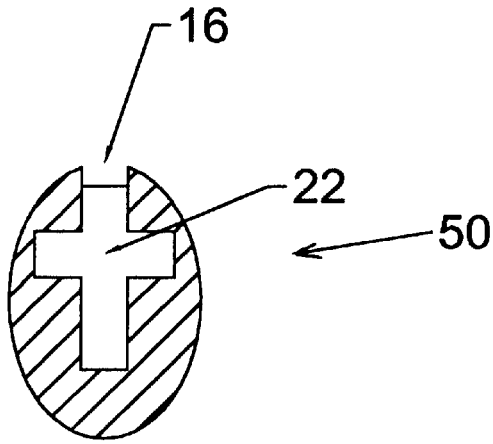
FIG. 13 is a sectional view of the edge strip of FIG. 11.

Similarly, an equivalent edge strip 50 of unitary construction, illustrated in FIGS. 11–13, is disclosed for vertical-edge applications where a bottom edge strip is not used. The strip 50 features a solid end plug 52 (seen in FIG. 11) designed to replace the corner section 12 removed from the modified mother plate 10. Accordingly, the end view of the strip shows a solid flat surface, as seen in FIG. 12. Otherwise, the strip 50 retains the same structural features of a conventional edge strip, including a channel 16 for receiving the edge of the mother plate and a slot 22 (seen in the cross-section of FIG. 13) for retaining pins 24.

As described above, an insert according to the invention is provided that fills the void that is created inside abutting edge strips by removing a corner portion 12 of the mother plate 10. In another aspect of the invention, which is described immediately below, the invention provides for sealing portions of the perimeter of the mother plate that are left unprotected by edge strips which are not abutting. The corner portion may or may not be removed from the mother plate.

Figure 14:
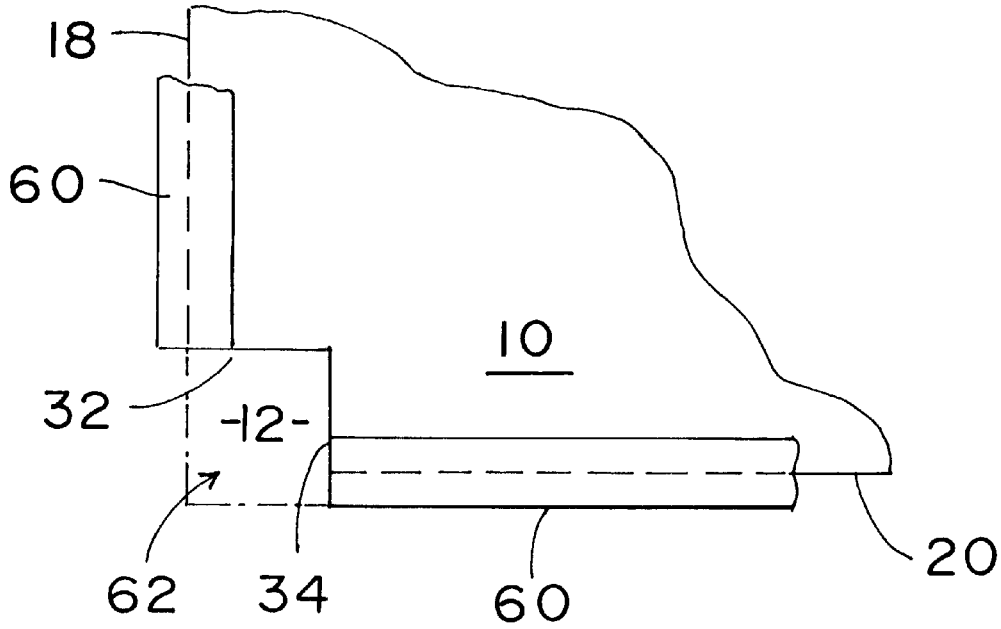
FIG. 14 is an elevational, fragmentary view of the mother plate of FIG. 1 and edge strips according to another aspect of the invention.

With reference to FIG. 14, edge strips 60 that sealingly receive edges 18 and 20 of the mother plate 10 need not extend into the space 62 (shown in phantom lines) that is defined by removing the corner 12 of the mother plate. This eaves the space 62 open for receiving an insert that connects between the edge strips 60 and seals with the remaining perimeter of the mother plate 10 that is associated with this space.

Figure 15:
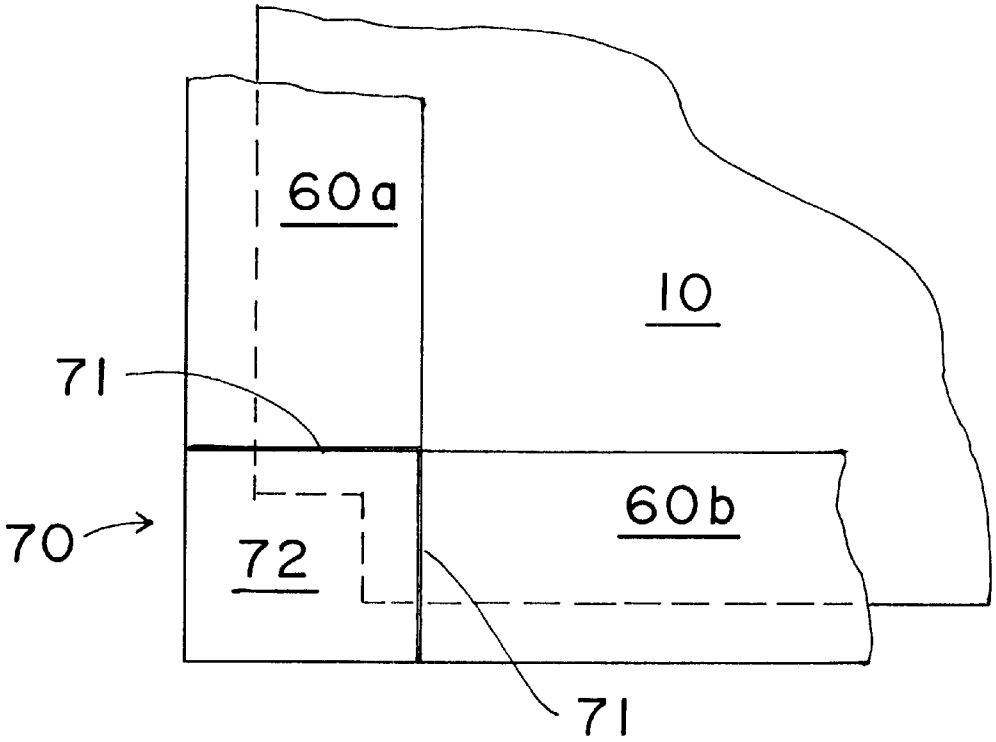
FIG. 15 is an elevational, fragmentary view of the mother plate of FIG. 1, edge strips according to the present invention and a corner member according to the present invention.

Turning to FIG. 15, a preferred insert 70 according to the present invention includes a comer member 72 of suitable dimensions for tightly connecting between edge strips 60*a* and 60*b*. Preferably, the comer member 72 of the insert 70 is formed of the same material as the edge strips, or is formed of a material or includes a material at edges 71 that abut the edge strips that is suitable to seal therewith so as to inhibit the formation of metallic bridges on the mother plate due to electrolyte penetration into corner junctions.

Figure 16:
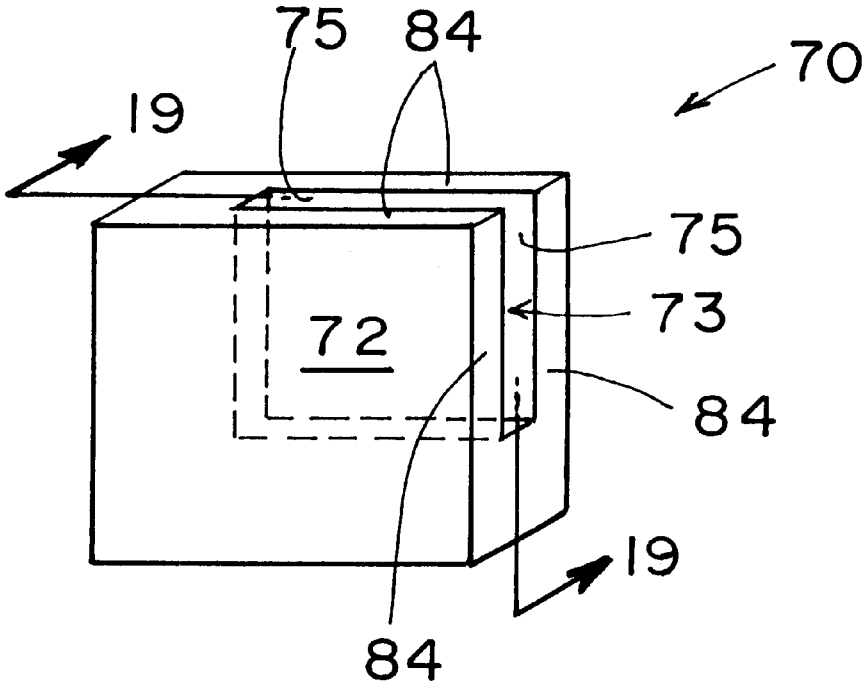
FIG. 16 is a pictorial view of a first embodiment of an insert according to the present invention.

Turning to FIG. 16, the insert 70 further includes an aperture 73 in the corner member adapted to receive the thickness of the mother plate 10, the aperture having sealing edges 84 for forming a suitable seal with the edge strips 60. The aperture also includes internal sealing surfaces 75 for sealing with the edges 32 and 34 of the mother plate 10. The sealing edges and surfaces may simply be the termination of the surfaces defining the aperture 73 as depicted, or they may be especially adapted for forming the seal, e.g., by being formed of a different material or by having a specialized geometry.

Figure 17:
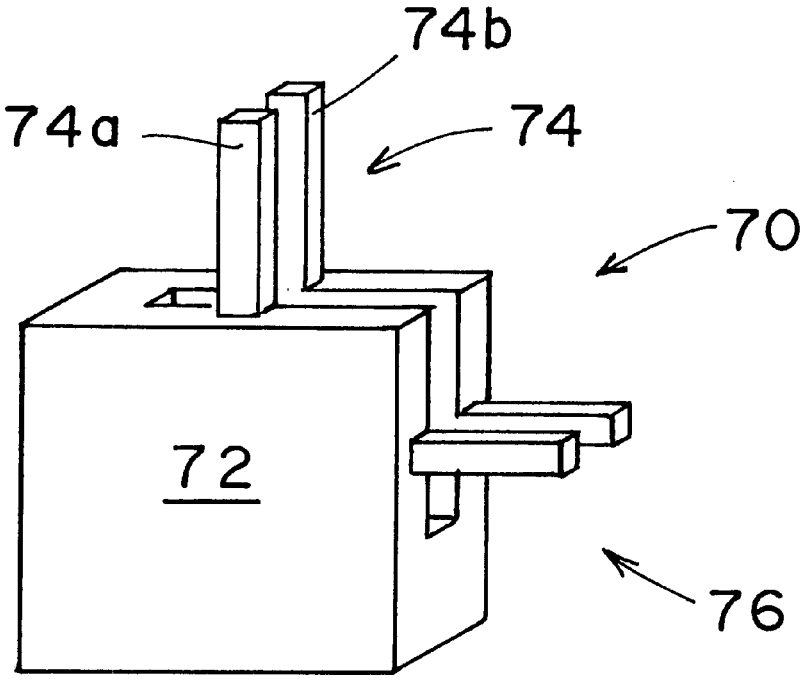
FIG. 17 is a pictorial view of the insert of FIG. 16 including a first embodiment of anchors according to the present invention.

Turning to FIG. 17, the insert 70 preferably includes anchors 74, 76, for anchoring the corner member 72 to the mother plate. Each anchor is sized so that it can be press-fit around the edge of the mother plate 10. This improves sealing between the insert and the mother plate, and provides a strong mechanical connection.

With further reference to FIG. 2, where the edge strips 60 include a channel 16 for receiving the edges 18 and 20 of the mother plate and a longitudinal slot 22, the anchors 74 and 76 may be adapted to fit snugly into the longitudinal slots 22 of respective edge strips. For this purpose, the anchors are provided with two parallel members, e.g., 74*a* and 74*b* which are spaced apart to permit snugly receiving the thickness of the mother plate 10, the parallel members being received in respective portions 22*a*, 22*b* of the slot 22.

Figure 18:
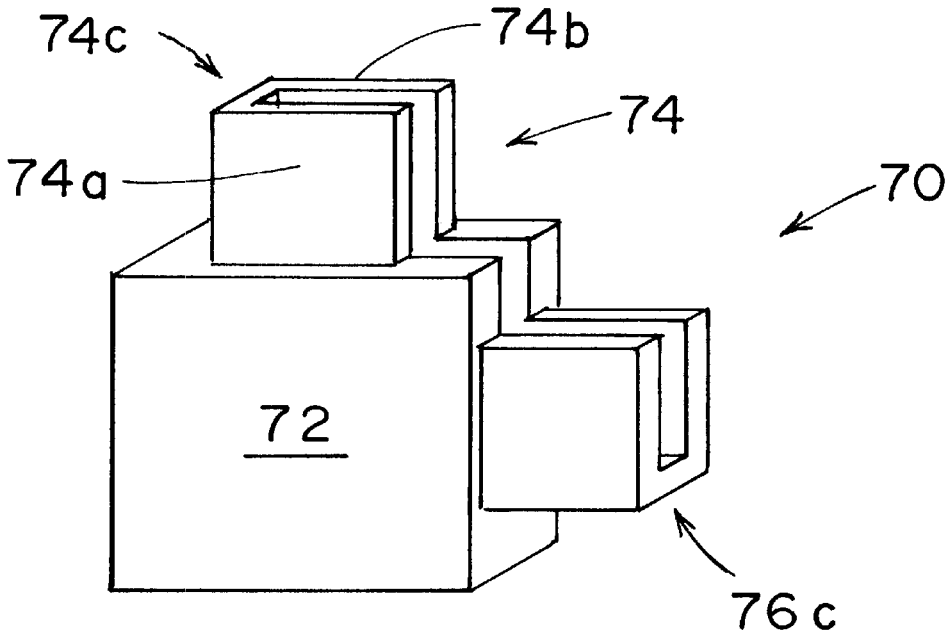
FIG. 18 is a pictorial view of the insert of FIG. 16 including a second embodiment of anchors according to the present invention.

Turning to FIG. 18, the parallel members 74*a* and 74*b*, and/or 76*a* and 76*b*, may be joined at respective outside edges 74*c*, 76*c* to form a closed corner. By comparing FIGS. 17 and 18, it is seen that the width of the parallel members is arbitrary within limits set by, on the one hand, the mechanical stiffness of the parallel members and, on the other, the size of the corner member 72.

Figure 19:
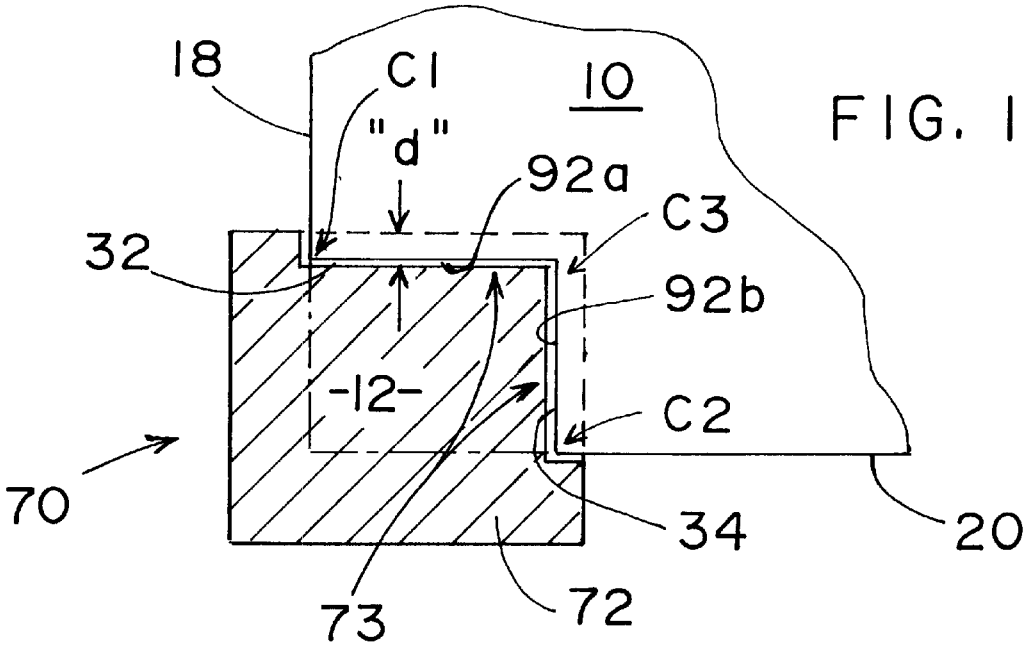
FIG. 19 is a sectional view of the insert of FIG. 16, taken along a line 19—19 thereof.

Turning to FIG. 19, the aperture 73 in the corner member preferably extends a depth "d" into the corner member 72 to form a channel that may be press-fit around the edges 32 and 34. The insert 70, when joined to the edge strips 60*a* and 60*b* and when receiving the mother plate 10 with the corner 12 removed, produces a compact corner assembly with minimal residual empty space. As will be readily appreciated, the aperture 73 may be alternatively shaped to accommodate a corner section 12 of different geometry, or may be enlarged to accommodate a mother plate 10 that has not had the corner section 12 removed.

For example, in FIG. 19, the mother plate 10 includes a side edge 18 and a bottom edge 20, which meets two corner edges 92*a* and 92*b* at respective points C1 and C2. The corner edges meet at a point C3 between the points C1 and C2. The edges 92 are not collinear with the respective side and bottom edges. Alternatively, there may be additional corner edges defining additional points Cn between the points C1 and C2, e.g, between the points C3 and C1, and/or between C3 and C2, and the angles between the corner edges need not be perpendicular. Where the corner section 12 has not been removed, the corner edges 92 are collinear with the respective side and bottom edges. As in the case of the embodiment 30 of FIG. 5, a glue or sealant may be applied to all abutting or mating surfaces and to fill any remaining gaps or interstices to further seal and strengthen the assembly.

Figure 20A:
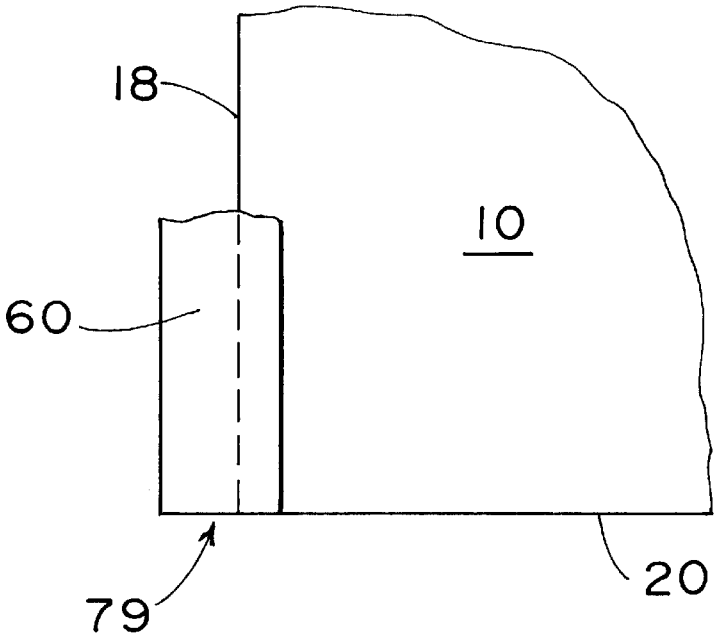
FIG. 20A illustrates an edge strip installed on a side edge of a mother plate so that the end of the edge strip is flush with the bottom edge of the mother plate.
Figure 20B:
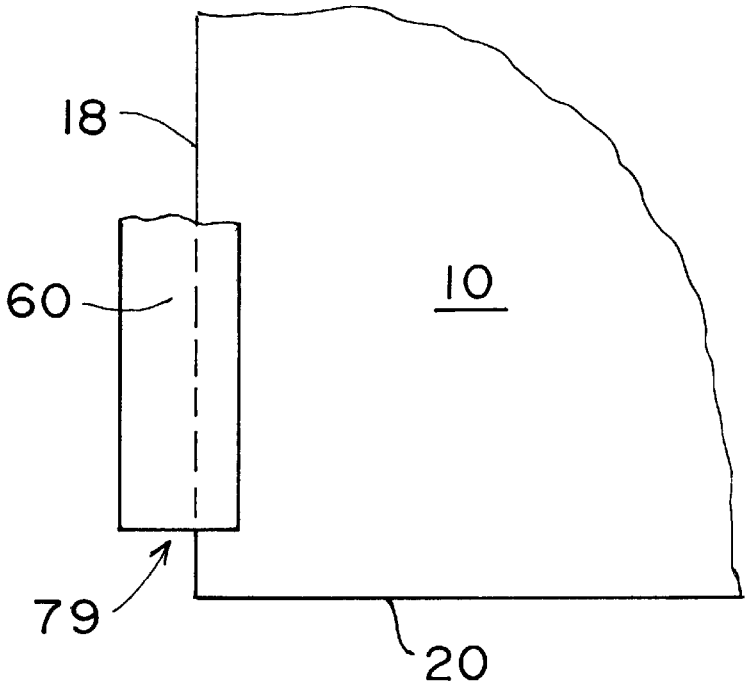
FIG. 20B illustrates the edge strip of FIG. 20A displaced upwardly so that the end of the edge strip is no longer flush with the bottom edge of the mother plate.

It is sometimes desirable not to provide an edge strip on the bottom edge 20 of the mother plate, and therefore to protect with edge strips only the two opposite sides of the plate. For example, the bottom edge 20 of the plate may be left open to ride on a chain. Edge strips 60 installed on a side edge 18 (FIG. 1) of the mother plate are positioned most advantageously so that ends 79 thereof are flush with the edge 20 as shown in FIG. 20. However, as a result of the rough treatment that the mother plate often receives in industrial use, the side edge strips can shift in position, typically sliding upwardly and leaving portions of the side edge 18 (FIG. 1) unprotected as shown in FIG. 20B.

Referring back to FIGS. 1 and 2 and as mentioned above, the edge strips typically have a longitudinal slot 22 running within the channel 16. Another problem posed by omission of the bottom edge strip is that this slot provides a conduit for conducting electrolyte to the mother plate.

Referring generally to FIGS. 21A–23C, to address these problems, yet another aspect of the invention provides edge strip inserts 80 that are especially adapted to close the ends of side edge strips when no bottom edge strip is provided, to provide a reliable and durable seal with the mother plate along the side edges thereof. The inserts 80 may be provided in a number of alternative configurations, such as (a) those particularly adapted for an edge strip that is attached to the mother plate so that its end 79 is not flush with the bottom edge of a mother plate that does not have section 12 (FIG. 1) removed from the corner of the mother plate; (b) those which are adapted for an edge strip that is attached to the mother plate so that its end is flush with the bottom edge of a mother plate that does have section 12 removed from the corner of the mother plate; (c) those which are adapted for an edge strip that is attached to the mother plate so that its end is flush with the bottom edge of a mother plate that does not have section 12 removed from the corner of the mother plate; and (d) those which are adapted for an edge strip that is attached to the mother plate so that its end is not flush with the bottom edge of a mother plate that does have section 12 removed from the corner of the mother plate.

Figure 21A:
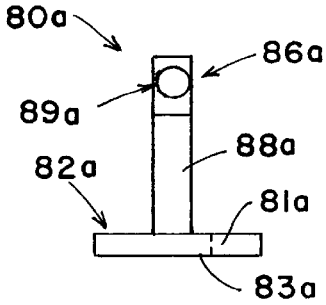
FIG. 21A is an elevational right side view of a second embodiment of an insert according to the present invention.
Figure 21B:
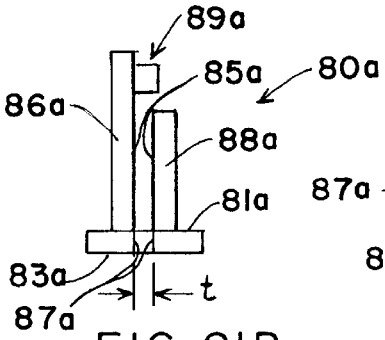
FIG. 21B is an elevational front view of the insert of FIG. 21A.
Figure 21C:
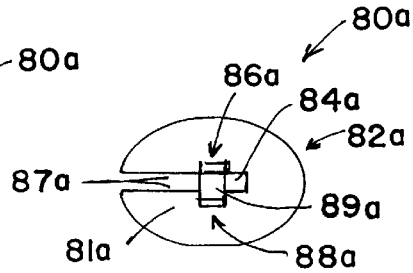
FIG. 21C is a top view of the insert of FIG. 21A.

Referring to FIGS. 21A–21C, an insert 80(*a*) is shown corresponding to the configuration (a) above. The insert 80(*a*) includes a base 82*a* having a slot 84*a*, and an anchor comprising two parallel prongs 86*a* and 88*a* projecting from a top surface 81*a* of the base and disposed about the slot so that inner surfaces 85*a* of the prongs are flush with corresponding sides 87*a* of the slot. The spacing "t" between these surfaces is ideally equal to the thickness of the mother plate, so that these surfaces may snugly receive the mother plate between the prongs, the bottom edge 20 (FIG. 1) of the mother plate extending to or beyond a bottom surface 83*a* (FIG. 21B) of the base through the slot.

Though it is less desirable, configuration (a) may also be implemented by providing a slot extending from the top surface into but not through the base, or by replacing the slot with a surface that is elevated with respect to the top surface of the base on which the edge 20 of the mother plate may rest, all without departing from the principles of the invention.

Turning back to FIGS. 1 and 2 and as mentioned previously, the longitudinal slot is provided to receive ends of pins 24 inserted through and protruding on both sides from the border of the mother plate 10. According to the invention, the insert or longitudinal slot is adapted in shape and size so that right and left side portions 22*a* and 22*b* (FIG. 2) of the longitudinal slot snugly receive the prongs 86*a* and 88*a*.

Also as mentioned previously, the pins 24 have been inserted through corresponding holes in the mother plate; however, according to the invention, at least one of these pins is preferably omitted leaving a corresponding empty hole, and the inserts 80*a* are adapted to take advantage of the existence of this hole. Particularly, one of the prongs 86*a* includes a pin 89*a* adapted in shape and size to project into and preferably through the empty hole in the mother plate when the mother plate is received between the surfaces 85*a* and 87*a*, to fill and seal the hole from electrolyte as well as provide a means for anchoring the insert 80*a* to the mother plate and, thereby, for anchoring the edge strip to the mother plate as described immediately below.

Because the edge strips are typically very stiff, it is most advantageous to install the insert onto the mother plate first, e.g., by spreading the prongs apart sufficiently so that the pin 89*a* clears the surface of the mother plate until the pin is positioned for insertion into the hole in the mother plate, and then to install the edge strip, e.g., by sliding the edge strip down along the side edge of the mother plate so as to engage the prongs in the respective portions 22*a*, 22*b* (FIG. 2) of the longitudinal slot, and finally abutting the end 79 (FIGS. 20*a* and 20*b*) of the edge strip snugly against the top surface 81 a of the base 82*a*. The top surface of the base seals against the end 79 along substantially the entire circumference "C" of the end 79 (FIG. 2), to prevent seepage of electrolyte into the slot 16 and longitudinal channel 22.

Figure 22A:
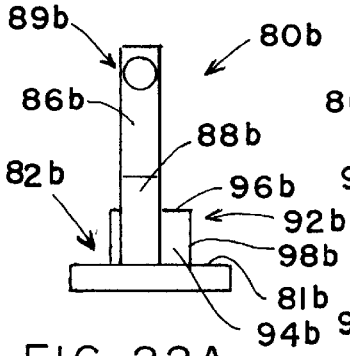
FIG. 22A is an elevational night side view of a third embodiment of an insert according to the present invention.
Figure 22B:
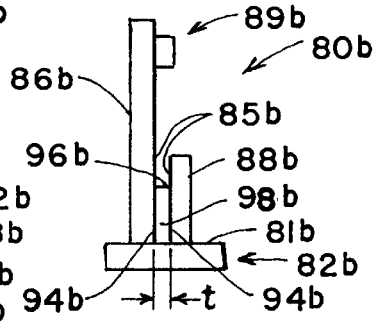
FIG. 22B is an elevational front view of the insert of FIG. 22A.
Figure 22C:
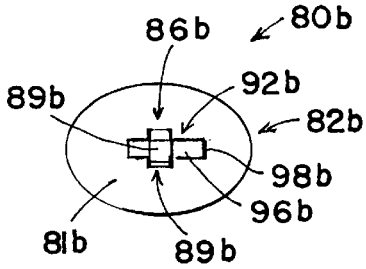
FIG. 22C is a top view of the insert of FIG. 22A.

Turning to FIGS. 22A–22C, an insert 80(*b*) is shown corresponding to the configuration (b) above. The insert 80(*b*) includes a base 82*b* having a corner section 92*b* and an anchor comprising two parallel prongs 86*b* and 88*b* projecting from top surface 81*b* of the base and disposed about the corner section so that inner surfaces 85*b* of the prongs are flush with corresponding faces 94*b* of the corner section. The corner section 92*b* is shaped to fit the section 12 (FIG. 1) that has been removed from the mother plate. The thickness of the corner section and the spacing "t" between the surfaces 85*b* is ideally equal to the thickness of the mother plate, so that the surfaces 85*b* snugly receive the mother plate between the prongs. Edge surfaces 96*b* and 98*b* of the corner section abuttingly receive edges 32 and 34 (FIG. 1) respectively of the mother plate, the bottom edge 20 (FIG. 1) of the mother plate extending to the top surface 81*b* (FIG. 21B) of the base.

As in the case of the insert 80*a*, one of the prongs 86*b* of the insert 80*b* preferably includes a pin 89*b* adapted in shape and size to project into and preferably through the empty hole in the mother plate when the mother plate is received snugly between the surfaces 85*b* and on top of the surface 96*b*, to fill and seal the hole from electrolyte as well as provide a means for anchoring the insert 80*b* to the mother plate and, thereby, for anchoring the edge strip to the mother plate.

Also as in the case of the insert 80*a*, it is most advantageous to install the insert 80*b* onto the mother plate first, e.g., by spreading the prongs apart sufficiently so that the pin 89*b* clears the surface of the mother plate until the pin is positioned for insertion into the hole in the mother plate, and then to install the edge strip, e.g., by sliding the edge strip down along the side edge of the mother plate so as to engage the prongs in the respective portions 22*a*, 22*b* (FIG. 2) of the longitudinal slot, and finally abutting the end 79 of the edge strip snugly against the top surface 81*b* of the base 82*b*.

Corresponding to the configuration (c) above, an insert 80*c* (not shown) may be provided that is similar to the insert 80*a*, except that the slot may be omitted so that the edge 20 of the mother plate is flush with the top surface of the base.

Figure 23A:
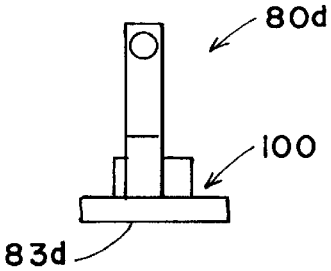
FIG. 23A is an elevational right side view of a third embodiment of an insert according to the present invention.
Figure 23B:
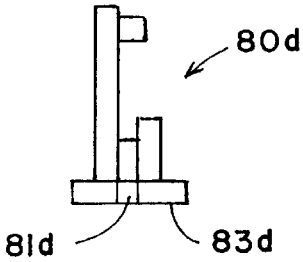
FIG. 23B is an elevational front view of the insert of FIG. 23A.
Figure 23C:
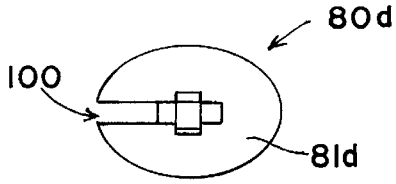
FIG. 23C is a top view view of the insert of FIG. 23A.

Corresponding to the configuration (d) above and referring to FIGS. 23A–23C, an insert 80*d* may be provided that is similar to the insert 80*b*, except that a slot 100 extending through a base 82*d* is provided so that the edge 20 of the mother board may be positioned to be flush with a bottom surface 83*d* of the base 82*d* instead of resting on the top surface 81*d* as in the insert 80*b*.

Though it is less desirable, configuration (d) may also be implemented by providing a slot extending from the top surface into but not through the base, or by replacing the slot with a surface that is elevated with respect to the top surface of the base on which the edge 20 of the mother plate may rest, all without departing from the principles of the invention.

Any of the inserts 80 may be provided in right or left hand form as required. As in the case of the embodiment 30 of FIG. 5, a glue or sealant may be applied to all abutting or mating surfaces and to fill any remaining gaps or interstices to further seal and strengthen the assembly. Preferably, the anchors of the inserts 80 are adapted to be press-fit around the edge of the mother plate 10.

It is clear that the insert of the invention has been described in terms of a conventional edge strip characterized by a longitudinal channel and a slot having the geometry illustrated in the figures. As one skilled in the art would readily understand, though, the invention can be used in equivalent fashion with any other type of edge strip, the fundamental idea being only to replace the missing corner piece of the mother plate with a nonconductive filler plug and, preferably, also with a binding material.

As will be readily apparent to a person of ordinary mechanical skill, an insert designed for a different type of edge strip would have to be modified to conform to the specific interior geometry of the strip.

Various changes in the details, steps and components that have been described may be made by those skilled in the art within the principles and scope of the invention herein illustrated and defined in the appended claims. Therefore, while the present invention has been shown and described herein in what is believed to be the most practical and preferred embodiments, it is recognized that departures can be made therefrom within the scope of the invention, which is not to be limited to the details disclosed herein but is to be accorded the full scope of the claims so as to embrace any and all equivalent processes and products.

We claim:

1. A corner insert for use with a first edge strip for use on an edge of an electrode having opposite faces, the corner insert comprising a corner member having an aperture that defines interior surfaces thereof adapted to seat against said two opposite faces, said corner member adapted to sealingly seat against an end of the edge strip.

2. The comer insert of claim 1, wherein said comer insert includes a first anchor attached to said corner member and adapted to be received in an interior portion of the edge strip.

3. The corner insert of claim 2, wherein said anchor is adapted to receive and seat against both the opposite faces of the electrode.

4. The corner insert of claim 2, wherein said corner insert includes a second anchor attached to said corner member and adapted to be received in an interior portion of a second edge strip for use on an adjacent edge of the electrode, said second anchor adapted to receive and seat against both the opposite faces of the electrode.

5. The corner insert of claim 1, wherein said interior surfaces are adapted to seat against an electrode that has side and bottom edges meeting at the corner of the electrode, the corner including two corner edges that meet and which are collinear with, respectively, the side and bottom edges, corresponding to an electrode for which the corner section has not been removed.

6. The corner insert of claim 1, wherein said interior surfaces are adapted to seat against an electrode that has side and bottom edges meeting at the comer of the electrode, the corner including two corner edges that meet and which are not collinear with, respectively, the side and bottom edges, corresponding to a corner section that has been removed from the electrode.

7. A corner insert for use with a first edge strip for use on an edge of an electrode having opposite faces, the electrode having a corner portion defined by at least two corner edges, the corner insert comprising a corner member having an aperture that defines interior surfaces thereof adapted to seat against said two opposite faces and against said corner edges.

8. The corner insert of claim 7, wherein said corner insert includes a first anchor attached to said corner member and adapted to be received in an interior portion of the edge strip.

9. The corner insert of claim 8, wherein said anchor is adapted to receive and seat against both the opposite faces of the electrode.

10. The corner insert of claim 8, wherein said corner insert includes a second anchor attached to said corner member and adapted to be received in an interior portion of a second edge strip for use on an adjacent edge of the electrode, said second anchor adapted to receive and seat against both the opposite faces of the electrode.

11. The corner insert of claim 7, wherein said interior surfaces are adapted to seat against an electrode that has side and bottom edges meeting at the corner of the electrode, the corner including two corner edges that meet and which are collinear with, respectively, the side and bottom edges, corresponding to an electrode for which the corner section has not been removed.

12. The corner insert of claim 7, wherein said interior surfaces are adapted to seat against an electrode that has side and bottom edges meeting at the corner of the electrode, the corner including two corner edges that meet and which are not collinear with, respectively, the side and bottom edges, corresponding to a corner section that has been removed from the electrode.

13. An edge strip insert for plugging an edge strip having an end defining a cross-sectional circumference, said edge strip including interior surfaces adapted to fit snugly against respective opposite sides of an electrode, the edge strip insert comprising a base from whose upper surface extend spaced-apart prongs, said prongs having interior surfaces adapted to seat, respectively, against the sides of the electrode, said upper surface of said base being adapted to seat against the end of the edge strip around the entire length of said circumference.

14. The edge strip insert of claim 13, wherein the electrode is a flat plate, and said internal surfaces are parallel, planar and spaced apart by the thickness of said plate.

15. The edge strip insert of claim 14, wherein said base is planar and has a circumferential shape that is substantially the same as the shape of said cross-sectional circumference.

16. The edge strip insert of claim 14, wherein said prongs extend from said base different amounts, wherein the prong extending the greatest amount includes a pin adapted to fit snugly within an aperture through the electrode.

17. The edge strip insert of claim 16, wherein said base includes a slot extending therethrough and disposed between said interior surfaces of said prongs, said slot having a width that is equal to the spacing between said interior surfaces.

18. The edge strip insert of claim 16, wherein said base includes a corner insert having two edges that meet one another, said two edges adapted to seat against corresponding corner edges of the electrode, said corner insert being disposed between said interior surfaces of said prongs and having a width that is equal to the spacing between said interior surfaces.

19. The edge strip insert of claim 18, wherein one of said edges of said corner insert extends from said upper surface of said base, wherein said base includes a slot extending therethrough flush with said one of said edges of said corner insert, said slot having a width that is equal to the spacing between said interior surfaces.

* * * * *

UNITED STATES PATENT AND TRADEMARK OFFICE

CERTIFICATE OF CORRECTION

PATENT NO. : 6,551,475 B2
DATED : April 22, 2003
INVENTOR(S) : Michael P. Dwyer et al.

It is certified that error appears in the above-identified patent and that said Letters Patent is hereby corrected as shown below:

Title page,
Item [57], ABSTRACT,
Line 10, change "removing the comers" to -- removing the corners --.

Column 11,
Line 36, change "The comer insert of claim 1, wherein said comer insert" to -- the corner insert of claim 1, wherein said corner insert --;
Line 56, change "the comer of the" to -- the corner of the --.

Signed and Sealed this

Twenty-sixth Day of October, 2004

JON W. DUDAS
*Director of the United States Patent and Trademark Office*